United States Patent [19]

Drach

[11] 4,372,448

[45] Feb. 8, 1983

[54] MULTI-PURPOSE KITCHEN DEVICE

[76] Inventor: Edward Drach, 275 McLean Ave., Yonkers, N.Y. 10705

[21] Appl. No.: 211,814

[22] Filed: Dec. 1, 1980

[51] Int. Cl.[3] ..... A47F 7/00

[52] U.S. Cl. ..... 211/41; D32/55; D32/56

[58] Field of Search ..... 211/41, 126, 2; D32/55, D32/56, 57; 206/557

[56] References Cited

U.S. PATENT DOCUMENTS

| | | | |
|---|---|---|---|
| D. 244,827 | 6/1977 | Nevi | D32/55 |
| 597,529 | 1/1898 | Schulze . | |
| 678,008 | 7/1901 | McKinney . | |
| 1,224,838 | 5/1917 | Blissman et al. . | |
| 1,327,039 | 1/1920 | Harris . | |
| 1,349,771 | 8/1920 | Kline . | |
| 1,406,773 | 2/1922 | Stoffel | 211/41 |
| 1,535,928 | 8/1923 | Loudon . | |
| 1,628,746 | 6/1926 | Russel . | |
| 1,643,906 | 1/1927 | Russel . | |
| 1,728,502 | 5/1928 | McGregor . | |
| 2,936,898 | 5/1960 | Miguez | 211/41 |
| 2,954,875 | 10/1960 | Becker | 211/41 |
| 3,027,041 | 3/1962 | Stansburg et al. | 211/41 X |
| 3,442,395 | 5/1969 | Taylor . | |

*Primary Examiner*—Roy D. Frazier
*Assistant Examiner*—Robert W. Gibson, Jr.
*Attorney, Agent, or Firm*—James & Franklin

[57] ABSTRACT

The device has first and second opposing surfaces each including first and second planar sections. The sections of the first surface are inclined with respect to each other along a center line at an angle greater than 180° and cooperate with upstanding side members to form drainage channels along the sides of the first surface. The sections of the second surface are inclined with respect to each other at an angle less than 180° to form a central drainage channel in the second surface. End members support each of the surfaces at an incline relative to the horizontal. One end member has drainage ports aligned with each of the channels and a container receiving opening, connected by means of a drainage channel, to the port aligned with the drainage channel on the second surface. The first surface has members thereon for retaining dishware, silverware and glassware. When used with the first surface facing upward, the device may be used as a dish rack and/or a drain board. When used with the second surface facing upward, the device may be used as a cutting board. In either orientation, the device may be used to wash food items.

19 Claims, 5 Drawing Figures

MULTI-PURPOSE KITCHEN DEVICE

The present invention relates to kitchen devices such as those designed for use as dish racks, drain boards, cutting boards and surfaces for washing items of food and, more particularly, to a single multi-purpose kitchen device capable of providing each of these functions, depending upon the orientation and mode of use thereof.

In the art, many different devices are known which, respectively, are usable as dish racks, drain boards, cutting boards, or surfaces for washing food items such as fresh vegetables and the like. However, each type of device has different structural requirements which permit same to be used in the required manner. Since the structural requirements for each type of device are considered to be mutually exclusive, separate devices have heretofore been provided for each individual use.

For example, a device designed to be used as a dish rack requires a surface with upstanding members to serve as a means to retain dishes, glassware and utensils in an upstanding position. On the other hand, a cutting board requires a substantially planar surface which has no upstanding members mounted thereon. Similarly, a drain board requires an inclined surface with an open end to permit drainage into a sink. On the other hand, a cutting board may be fashioned to permit drainage of juices into a container for later use.

The present invention is designed to permit a variety of uses with a single device. Thus, the device can be used as a dish rack, a drain board, a cutting board or a surface for washing food items, depending upon the orientation thereof and the mode of use. In this way, one need only purchase a single device to provide all of these functions, significantly reducing cost and storage space.

It is, therefore, a prime object of the present invention to provide a single multi-purpose kitchen device which can be used as a dish rack, a cutting board, a drain board or a surface for rinsing food items, such as vegetables and the like.

It is a second object of the present invention to provide a multi-purpose kitchen device which can be used to provide each of the above-mentioned functions at a reduced cost and which requires a minimum of storage space.

In accordance with the present invention, a multi-purpose kitchen device is provided comprising a first and a second surface. Each surface has a first and a second section. The sections of the first surface are inclined with respect to each other at an angle greater than 180°. The sections of the second surface are inclined with respect to each other at an angle less than 180°. The sections of the second surface form a drainage channel in the second surface. First and second side members extend from and cooperate with the edges of the respective sections of the first surface to form drainage channels along the sides of the first surface. Means are provided for supporting each of the surfaces at an incline with respect to the horizontal. Means, extending from the first surface, are provided for retaining articles thereon.

The first and second surfaces are opposing surfaces. The device can be used in one of two orientations, either with the first surface facing upward, or with the second surface facing upward. In the first orientation, the device acts either as a dishrack and/or a drain board. The sections of the first surface are inclined downwardly from the center line of the device towards the sides thereof, such that liquid drains into the side channels. When oriented with the second surface facing upward, the device acts as a cutting board. In this orientation, the sections of the second surface are inclined downwardly towards the center channel and juices or other liquids flow towards the center channel. In either orientation, the device may be used to wash or rinse food items of various types.

The device further comprises a first member mounted on one end of the surfaces. The end member is provided with first and second drainage ports which are aligned with the side drainage channels on the first surface. When used in the first orientation, the first end member permits liquid from the side drainage channels to drain into a sink.

The end member is also provided with a third drainage port which is aligned with the drainage channel on the second surface. When the device is used in the second orientation, as a cutting board or a surface for rinsing food items, the liquid collected in the central drainage channel exits through the third drainage port in the first end member.

The first end member has an opening therein which, in the second orientation, is below and aligned with the third drainage port. The opening is adapted to receive a container, such as a dish or bowl therein. The first end member is also provided with a drainage channel connecting the third drainage port and the opening. When used in the second orientation as a cutting board, it may be desirable to collect juices for later use. In order to do this, a dish or other container is situated within the opening in the first end member below the drainage channel therein, such that the juices collected in the center channel of the second surface pass through the third drainage port in the first end member, along the drainage channel in the first end member and into the dish positioned in the opening. Alternatively, the device can be situated adjacent to a sink such that liquid from the drainage channel in the end member will flow directly into the sink.

The first end member extends between the first and second side members, as does a second end member situated on the other end of the device. The end members comprise the support means which serve to support each of the surfaces at an incline relative to the horizontal. It is desirable to support the surfaces at an incline relative to the horizontal such that liquid collected in the drainage channels will be gravity-fed to the ports in the first end member. In addition, each end member is provided with sink rim engaging members such that the device can be suspended from the rim of a sink, with the body thereof within the sink. This is particularly useful when the device is used as a drain board or for washing or rinsing food items, as it permits liquid to drain directly into the sink.

As mentioned above, the first surface has means thereon for retaining articles such as dishes, glassware and silverware. Thus, when used as a dish rack and/or drain board, the device has facility for holding a variety of different kitchen articles.

To these and such other objects as may hereinafter appear, the present invention relates to a multi-purpose kitchen device, as described in the following specification and recited in the annexed claims, taken together with the accompanying drawings, wherein like numerals refer to like parts, and in which:

Figure 1:
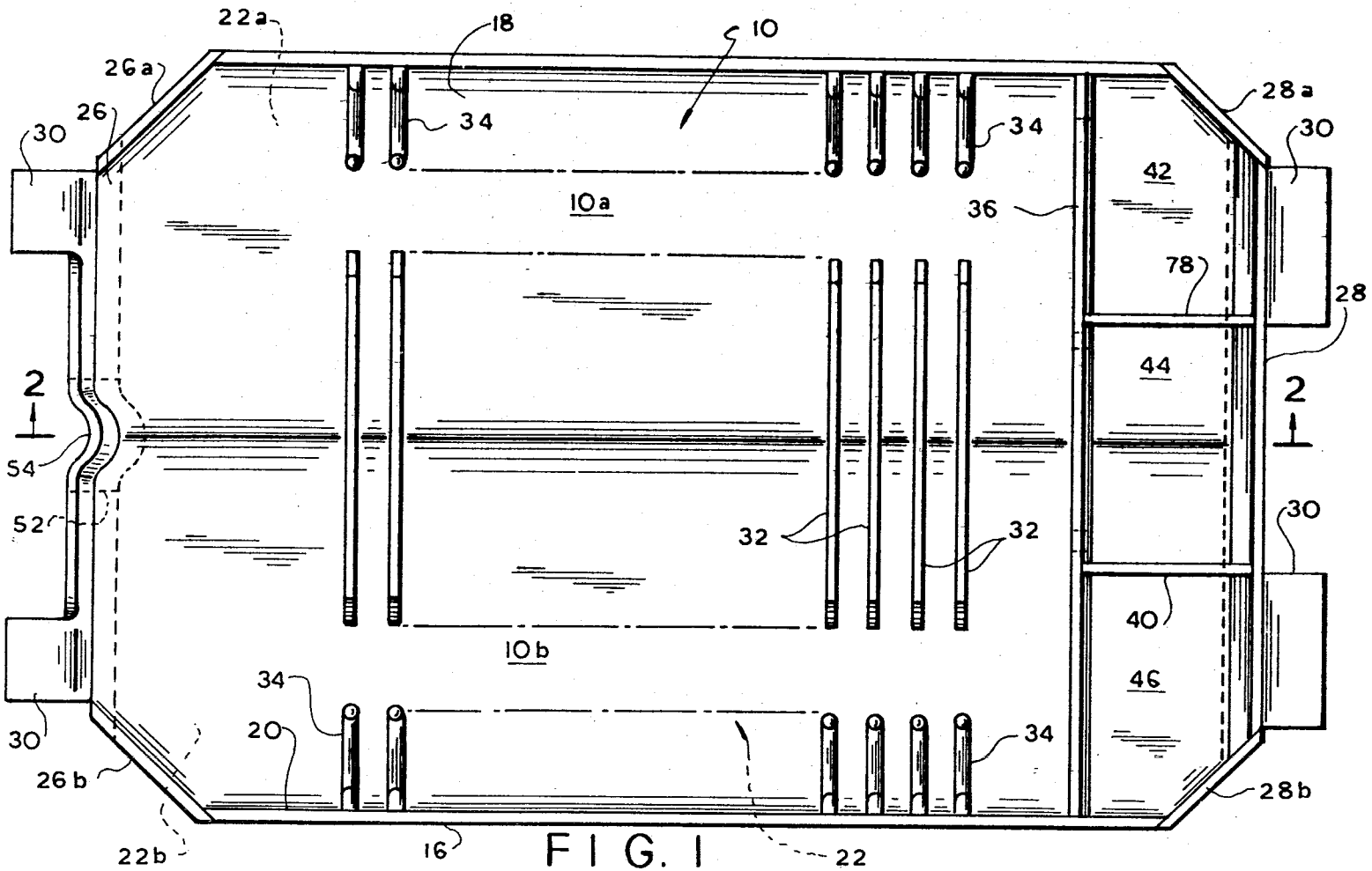
FIG. 1 is a top plan view of the multi-purpose kitchen device of the present invention.

As seen in FIG. 1, the present invention comprises a first surface 10 having first and second substantially planar sections 10*a*, 10*b*. Sections 10*a* and 10*b* meet along a center line 12 at an angle greater than 180° such that surface 10 slopes outwardly and downwardly from center line 12 towards the sides thereof. Each side of surface 10 is provided with a substantially upstanding side member 14, 16. Section 10*a* and side member 14 cooperate to form a liquid drainage channel 18 along one side of the device. Similarly, section 10*b* and side member 16 cooperate to form a second liquid drainage channel 20 along the other side of the device.

On the other side of surface 10 is a surface, generally designated 22, having first and second substantially planar sections 22*a* and 22*b*. Sections 22*a* and 22*b* meet along center line 12 at an angle less than 180° so as to form a central drainage channel 24 along the center line of surface 22.

First and second end members 26, 28, respectively, extend from surface 10 between side members 14 and 16 at either end of the device. Each end member 26, 28 is provided at either side thereof with a portion 26*a*, 26*b*, and 28*a*, 28*b*, respectively, which is inclined with respect to the main portion of the end member. Mounted to and extending outwardly from the main portion of each of the end members 26 and 28 are sink rim engaging members 30.

When used in the first orientation, with surface 10 facing upward, the device may be utilized on a counter top adjacent to a sink or the device may be placed within the sink itself. In the latter instance, sink rim engaging members 30 are designed to rest on the sink rim, at opposite sides of the sink, so as to support the device. Members 30 are situated such that when the device is suspended from the sink rim, surface 10 will be inclined towards end member 26 with respect to the horizontal such that liquid will flow from the center line 12 towards side members 14, 16 along channels 18 and 20 towards end member 26. Portions 26*a*, 26*b* and 28*a*, 28*b* are provided in order to accommodate the rounded corners of most conventional sinks.

Located on surface 10, extending outwardly therefrom in the same direction as side members 14 and 16, are a plurality of dish retaining members 32, only some of which are shown. Members 32 permit dishes to be stacked in spaced, upstanding relation. Extending from side members 14 and 16 are substantially cylindrical protrusions 34, only some of which are shown, designed to hold glassware or the like along the sides of the device.

A member 36 is provided, also extending outwardy from surface 10, between side walls 14 and 16 near the rear of the device. Two other members 38, 40, extending between member 36 and end member 28, are provided to divide the rear of the device into three compartments 42, 44, 46. Compartments 42, 44 and 46 are designed to receive silverware therein and hold same upright.

Figure 2:
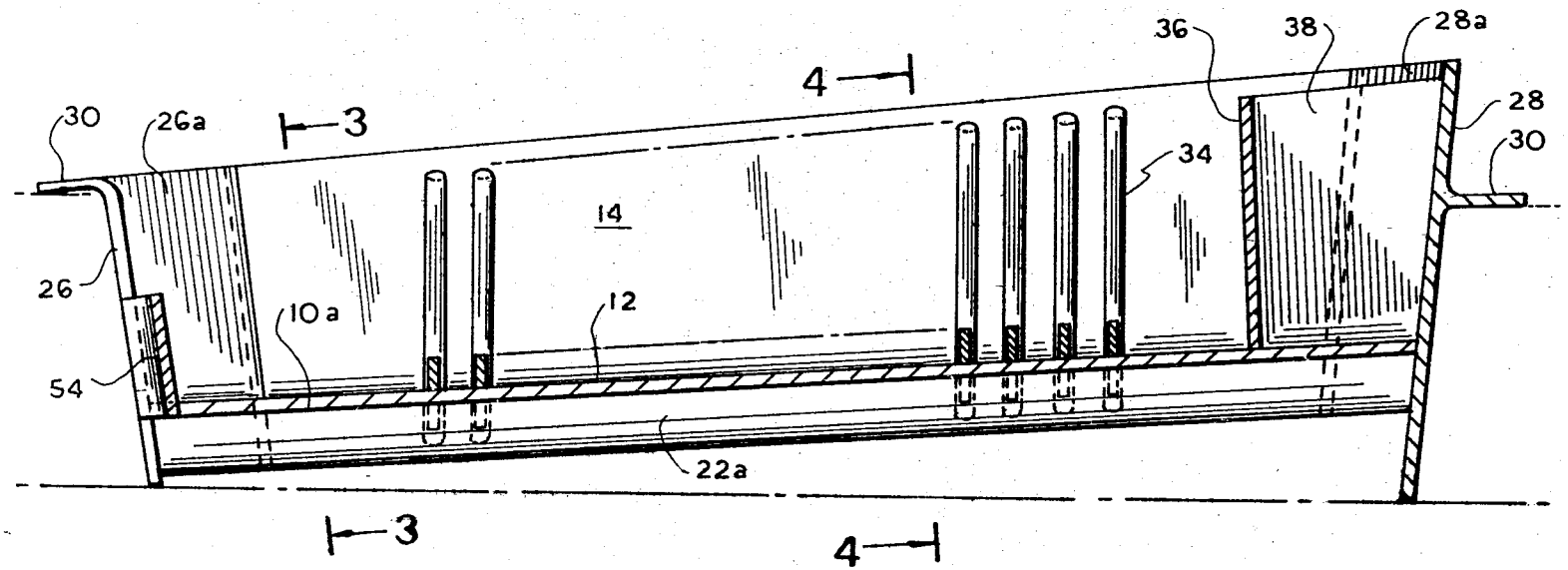
FIG. 2 is a cross-sectional view of the multi-purpose kitchen device of the present invention, taken along line 2—2 of FIG. 1, showing the device in the first orientation.

FIG. 2 shows the device in its first orientation such that it can be used as a dish rack and/or a drain board. As will be appreciated from this drawing, end members 26 and 28 extend below surface 22 and act as supports for the body of the device. End members 26, 28 are fashioned such that surface 10 will be inclined with respect to the horizontal, toward end member 26, when the device is placed on a counter top or the like, in this orientation. As mentioned before, sink rim engaging members 30 are positioned to provide the same effect when the device is used within a sink.

Figure 3:
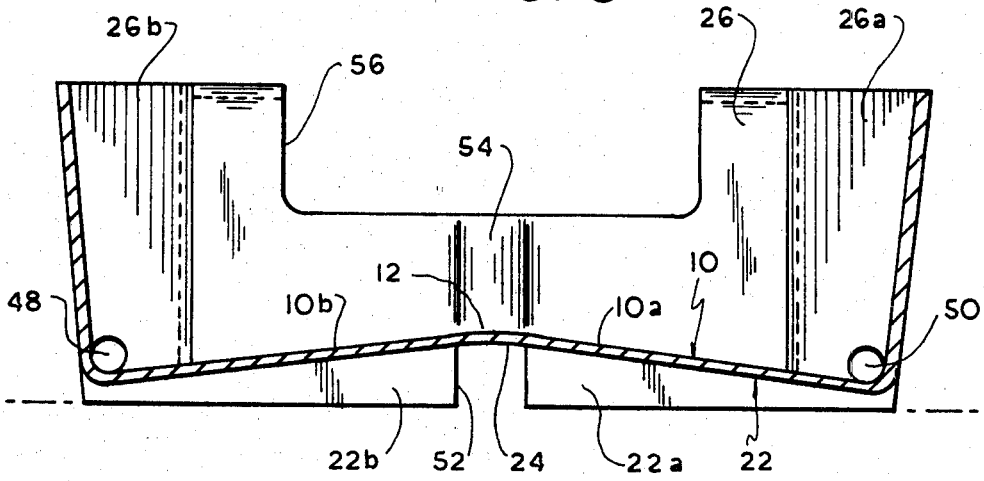
FIG. 3 is a cross-sectional view of the multi-purpose kitchen device of the present invention, taken along line 3—3 of FIG. 2.

FIG. 3 illustrates the structure of end member 26. Sections 26*a* and 26*b* are provided with liquid drainage ports 48, 50, aligned with drainage channels 18, 20, respectively, along the sides of surface 10. This permits liquid flowing along drainage channels 18 and 20 to pass through member 26 into a sink or the like. In addition, member 26 is provided with an opening 52, aligned with central drainage channel 24 in surface 22 which acts as a drainage port therefor. Aligned with drainage port 52, along the exterior surface of member 26, is a semi-cylindrical drainage channel 54 which connects central drainage port 52 with a larger opening 56 which is adapted to receive a container such as a dish or the like. When the device is used in the second orientation, with surface 22 facing upward, liquid drains along the central channel 24 of surface 22 through port 52 in member 26, along channel 54 in member 26, and into a dish or plate situated within opening 56, in order to preserve juices and the like for future use. Alternatively, the device can be situated adjacent to a sink such that the liquid drains from channel 54 directly into the sink.

Figure 4:
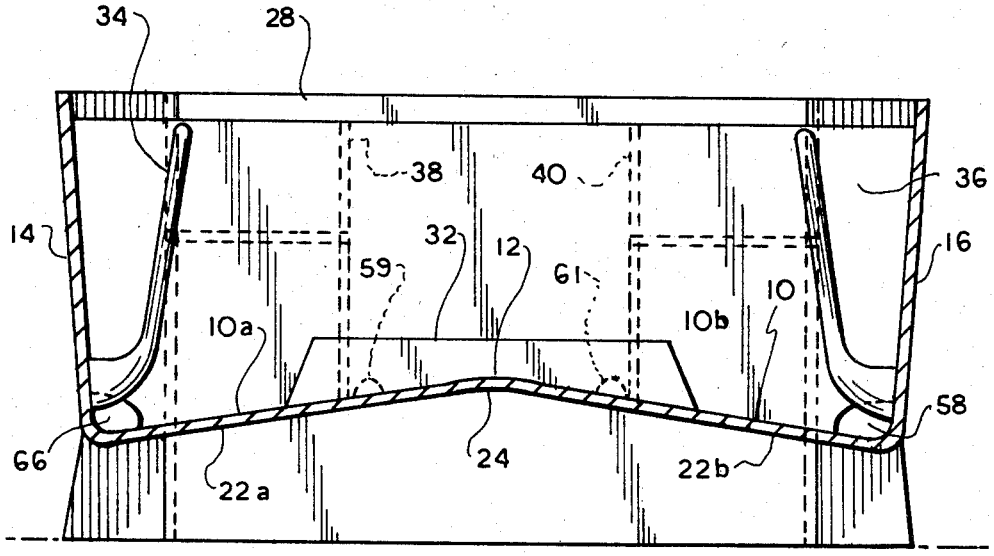
FIG. 4 is a cross-sectional view of the multi-purpose kitchen device of the present invention, taken along line 4—4 of FIG. 2; and, FIG. 5 is a cross-sectional view of the multi-purpose kitchen device of the present invention, taken along line 2—2 of FIG. 1, showing the device in the second orientation.

FIG. 4 shows that member 36, which defines the front portion silverware containing compartments 42, 44 and 46, is provided with liquid ports 58, 59, 60, 61. Ports 58 and 60 are aligned with side drainage channels 18, 20, respectively, and permit liquid to drain from the silverware containing compartments 42 and 46 into drainage channels 18, 20. Ports 59 and 61 permit liquid drainage from compartment 44 onto surface 10 and, thereafter, with channels 18, 20.

Figure 5:
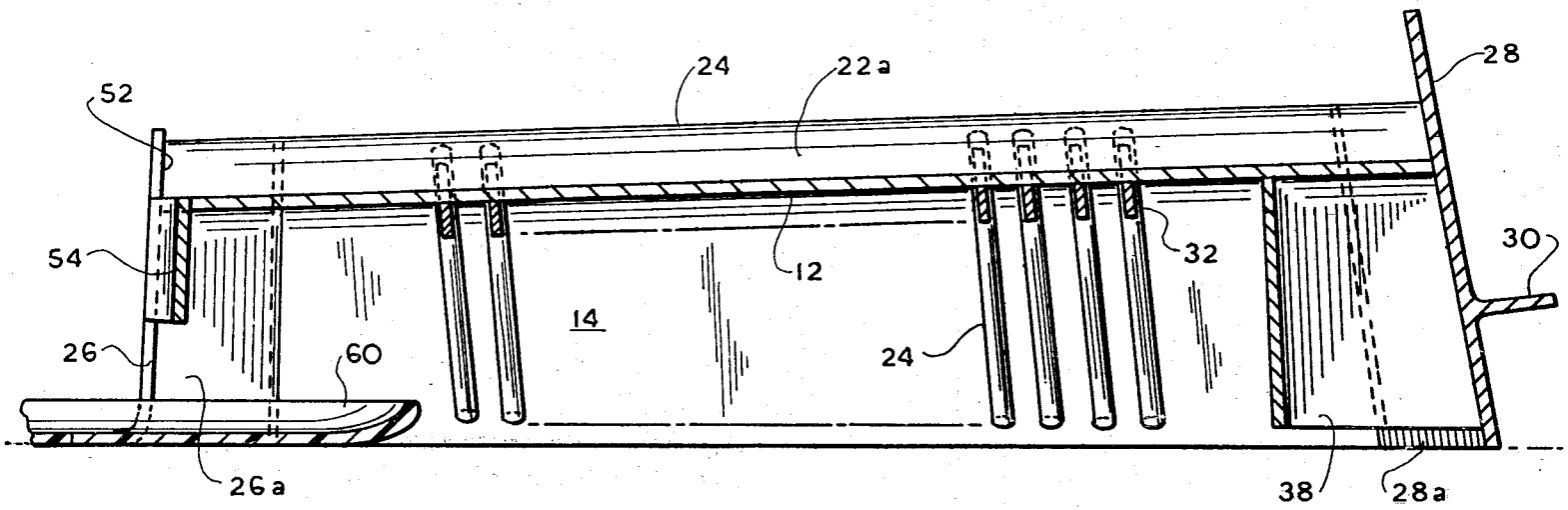

FIG. 5 illustrates the manner in which the device is used in its second orientation, that is, when surface 22 faces upward. In this orientation also, members 26 and 28 maintain surface 22 inclined with respect to the horizontal in a direction towards member 26. Juices or other liquids to be collected flow down surfaces 22*a* and 22*b* towards central drainage channel 24. The juices flow along central drainage channel 24 through port 52 along channel 54 and may drain into a dish or bowl 60 situated within opening 56 in end member 26. Alternatively, liquid from channel 54 can drain directly into a sink, if desired.

It will now be appreciated that the present invention relates to a multi-purpose kitchen device which may be used as a dish rack and/or a drain board, in one orientation, and a cutting board, in a second orientation. The device may be used to wash or rinse food items in either orientation. In the first orientation, dishes, glassware and silverware are retained in upright positions with respect to surface 10, which is facing upward. Liquid draining from these articles or from food items being washed flows from the center line of surface 10 towards the sides thereof into channels 18 and 20. From the silverware containing compartments, the liquid flows through ports 58, 59, 60 and 61 into the side drainage channels 18 and 20. Liquid flows along side drainage channels 18 and 20 through ports 50 and 48 in front end member 26 into a sink or the like because surface 10 is held at an incline with respect to the horizontal by end members 26 and 28.

In the second orientation, with surface 22 facing upward, liquids flow towards the center line of the device to central drainage channel 24 and, thereafter, through central drainage port 52 in end member 26. The liquid then flows along channel 54 into a container or dish situated within opening 56 of member 26. In this manner, juices from meat or the like, which flow therefrom during cutting and/or carving, may be collected and retained. Alternatively, the liquid from channel 54 can drain directly into a sink if same is to be discarded. Surface 22 is held at an incline with respect to the horizontal toward member 26 by end members 26 and 28.

While only a single preferred embodiment of the present invention has been disclosed herein for purposes of illustration, it is obvious that many variations and modifications could be made thereto. It is intended to cover all of these modifications and variations which fall within the scope of the present invention, as defined by the following claims.

I claim:

1. A multi-purpose kitchen device comprising first and second opposing surfaces, each having first and second sections, said sections of said first surface being inclined with respect to each other at an angle greater than 180 degrees, said sections of said second surface being inclined with respect to each other at an angle less than 180 degrees, to form a drainage channel in said second surface, first and second side members, extending from and cooperating with the edges of said respective sections of said first surface, to form drainage channels along the sides of said first surface, a first end member mounted on one end of said device, said first end member having first and second drainage ports aligned with said drainage channels on said first surface, means for supporting each of said surfaces at an incline relative to the horizontal and means, extending from said first surface, for retaining articles thereon.

2. The device of claim 1, wherein said first end member has a third drainage port aligned with the drainage channel on said second surface.

3. The device of claim 1, wherein said first end member extends between said first and second side members.

4. The device of claim 1, further comprising a second member mounted on the other end of said device.

5. The device of claim 4, wherein said end members comprise said support means.

6. The device of claim 1, wherein said article holding means comprises means for holding dishware.

7. The device of claim 1, wherein said article holding means comprises means for holding glassware.

8. The device of claim 1, wherein said article holding means comprises a silverware compartment having a drainage port aligned with one of said drainage channels on said first surface.

9. The device of claim 8, further comprising an end member, and wherein said end member comprises a part of said silverware compartment.

10. The device of claim 1, further comprising sink rim engaging means extending from said first end member.

11. The device of claim 2, wherein said first end member comprises an opening therein aligned with said third drainage port, said opening being adapted to receive a liquid container therein.

12. The device of claim 11, further comprising a drainage channel in said first end member connecting said third drainage port and said opening.

13. The device of claim 1, wherein said sections of said first surface are substantially planar.

14. The device of claim 1, wherein said sections of said second surface are substantially planar.

15. A multi-purpose kitchen device comprising first and second opposing surfaces, first and second liquid drainage channels situated along the sides of said first surface, a third liquid drainage channel situated along the center of said second surface, a first end member mounted to one end of the surfaces, said first end member having first and second drainage ports aligned with said drainage channels on said first surface, and a third drainage port aligned with said drainage channel on said second surface, means for supporting each of said surfaces at an incline towards said first end member, and means mounted on said first surface for retaining dishware thereon.

16. The device of claim 15, wherein said first end member comprises an opening therein, said opening being adapted to receive a container therein.

17. The device of claim 16, further comprising a drainage channel in said first end member operably connecting said third drainage port and said opening.

18. The device of claim 15, wherein said second surface comprises first and second substantially planar sections.

19. The device of claim 18, wherein said sections of said second surface are inclined towards the center line of said second surface.

* * * * *